United States Patent [19]

Pollock

[11] Patent Number: 5,050,870

[45] Date of Patent: Sep. 24, 1991

[54] WATER FILLED EXCERCISE WEIGHT

[76] Inventor: Todd E. Pollock, W. 3216-21st Ave., Spokane, Wash. 99204

[21] Appl. No.: 575,842

[22] Filed: Aug. 31, 1990

[51] Int. Cl.[5] ..... A63B 21/065; A63B 23/00; A61F 7/00

[52] U.S. Cl. ..... 272/119; 272/67; 128/402

[58] Field of Search ..... 272/67, 96, 117, 119, 272/122; 128/402, 403

[56] References Cited

U.S. PATENT DOCUMENTS

| | | | |
|---|---|---|---|
| 1,366,200 | 1/1921 | Matysek . | |
| 2,602,302 | 7/1952 | Poux | 128/402 |
| 3,231,270 | 1/1966 | Winer . | |
| 3,334,899 | 8/1967 | Bosko et al. . | |
| 3,532,339 | 10/1970 | Smith | 272/119 |
| 4,029,312 | 6/1977 | Wright | 272/123 |
| 4,076,236 | 2/1978 | Ionei | 272/123 |
| 4,108,146 | 8/1978 | Golden | 128/402 |
| 4,199,140 | 4/1989 | Ferretti | 272/123 |
| 4,361,324 | 11/1982 | Baroi | 272/123 |
| 4,405,129 | 9/1983 | Stuckey | 272/96 |
| 4,575,074 | 3/1986 | Damratoski | 272/119 |
| 4,592,358 | 6/1986 | Westplate | 128/402 |
| 4,685,665 | 8/1987 | Carlisle | 272/67 |
| 4,854,319 | 8/1989 | Tobin | 128/402 |
| 4,854,575 | 8/1989 | Wilson et al. | 272/122 |
| 4,854,576 | 8/1989 | McWain | 272/123 |
| 4,951,940 | 8/1990 | Vitello et al. | 272/119 |

*Primary Examiner*—Richard J. Apley
*Assistant Examiner*—Karen G. Horowitz
*Attorney, Agent, or Firm*—Keith S. Bergman

[57] ABSTRACT

An elongate flexible exercise weight releasably attachable about human limbs for exercise purposes provides a peripherally defined containment structure that is adjustably filled with water for selected, finely determinable weight. End tabs may be releasably fastened together to form the weight into a continuous band for maintenance on human limbs. The weight is peripherally defined by a fluid impervious membrane that has baffle means in its interior chamber to allow filling from a single orifice but inhibit rapid motion of substantial amounts of fluid responsive to motion of the exercise device.

1 Claim, 3 Drawing Sheets

21
20
22
23
24
25
26
27
28
29
30
31
32
33
34
35
36
37
38

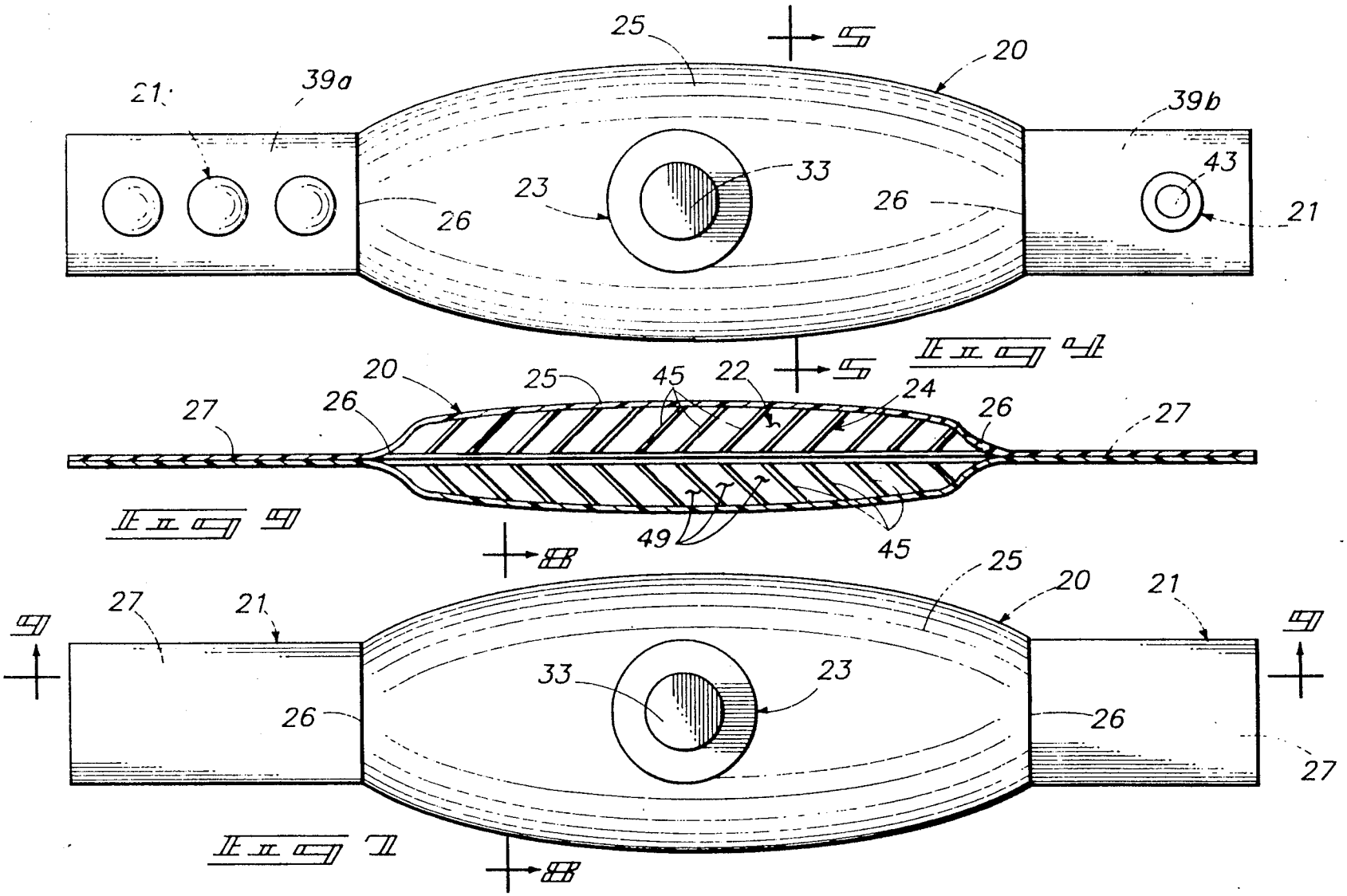
21
43
39b
20
26
33
25
23
26
39a
21
5
27
26
24
45
22
45
49
25
20
26
27
4
27
21
26
20
25
23
33
26
21
27
5
4
3

WATER FILLED EXCERCISE WEIGHT

BACKGROUND OF THE INVENTION

1. Related Applications

There are no applications related hereto heretofore filed by the instant inventor in this or any foreign country.

2. Field of Invention

My invention relates generally to exercise weights, and more particularly to water filled weights of selectively adjustable mass and flexible nature that may be releasably fastened about a user's limbs for positional maintenance during use.

BACKGROUND AND DESCRIPTION OF PRIOR ART

Exercise in one form or another is essential to human existence and generally is a natural part of that existence. Unfortunately as cultures develop and become more sophisticated, the natural forms of exercise inherent in their early ontology tend to disappear and responsively, various artificial forms of exercise have to be developed. The instant invention seeks to provide a new and novel weight-type device to aid exercise of human limbs and various muscle groups associated therewith.

Exercise of human limbs may be accomplished merely by motion of the limbs, but the process of strengthening and conditioning is more effectively and rapidly accomplished by motion of the limbs against some resistive force tending to prevent the motion. The most common and simplest method of creating such resistive force is a passive weight carried by a limb and moved either against gravity or its own inertia. Such passive weights have long been known and are commonly used in the exercise arts, such as in the form of barbells, dumbbells, weighted shoes and the like. My invention provides a new and novel member of this class of exercise devices.

Passive weights must necessarily be positionally maintained relative to limbs or limb portions to be exercised during exercise motion. Commonly in the case of arm exercises, passive weights have taken a form in which they may be manually held by providing some sort of a structurally associated handle structure that may be grasped by a user's hand. Weights for exercise of the legs or the medial portions of limbs generally have provided some sort of releasable fastening means for positional maintenance, primarily in the form of straps or ties associated with the weight for releasable fastening about a limb. My weight is distinguished from these devices in that the weight structure itself constitutes an elongate flexible band-like element having fastening means at each end so that the weight device itself may be wrapped around a portion of a limb and its ends fastened to each other to form an endless hand for positional maintenance during exercise activities. My weight does not provide any handle structure separately defined as such, nor any separate strap or tie fastening means, though if desired it may also be used in a hand held fashion.

It is convenient that a passive type exercise device should be readily transportable as it often may be desired for use in various places. Transportability of such device is aided primarily by lessening its mass, its volume, or both. My apparatus accomplishes both of these functions by providing a weight that gains its mass from being filled by a removable dense material, preferably a fluidic medium such as water. The peripheral membrane defining the enclosed chamber has an orifice that is opened and closed by manual manipulation so that fluidic medium may be removed during periods of non-use and transport to substantially lessen both the volume and mass of the device during these periods. This feature distinguishes the instant apparatus from prior devices that do not have removable weighting material and also from those having removable weighting material contained in rigid containers, as the latter type devices tend to maintain their volume with or without the weighting material, whereas the instant invention does not do so because its peripheral membrane is collapsed when not filled.

The fluidic weighting medium provides an added benefit in allowing preselected amounts of fluid to be contained in the device to provide a single exercise weight that may have selectively variable mass. This result is accomplished merely by filling the device to an appropriate capacity to provide the desired weight. This feature is advantageous for any type of exercise, but is especially desirable in athletic training and physical therapy where the mass of exercise weights is often required to be selectively varied and finely regulated to accomplish desired results.

It has heretofore been known to use fluidic medium in exercise devices for the purposes of adjustably varying the mass of such devices. In general when this is done, if an exercise device defines a fixed volume, its total volume may not be completely filled with fluidic medium, but rather the device is filled partially with fluidic media and partially with air. This situation tends to allow a "sloshing" or rapid movement of the fluidic medium about its container responsive to motion of the container, and this generally is not desirable and sometimes even dangerous in passive exercise weights. Prior art devices generally have resolved this problem by providing rigid or semi-rigid compound containers that have parts which move in one fashion or another to change the volume of fluid that may be contained to provide a chamber that will be completely filled with lesser than maximum amounts of fluid that the container may contain. Such structures have been relatively complex and correspondingly expensive, difficult of use, of relatively high maintenance and short life. My invention differs from this prior art firstly, in providing a flexibly designed chamber that will regulate its volume to the amount of fluid contained therein and secondly, by dividing the interior containment space of the chamber into a plurality of interconnected subchambers or somewhat differentiated volumes with orifices or passageways therebetween arrayed and sized to prevent rapid motion of large volumes of fluidic medium therethrough, while yet providing intercommunication to allow the filling and emptying of the device through a single orifice.

My invention resides not in any one of these features per se, but rather in the synergistic combination of all of its structures that give rise to the functions necessarily flowing therefrom as herein specified and claimed.

SUMMARY OF INVENTION

My invention generally provides a peripherally defined elongate tubular container formed from a flexible fluid impervious membrane with fastening tabs extending from each of its longer ends to adjustably and releasably fasten with each other. The tubular container encloses an internal fluid carrying chamber that has a releasably closable orifice for input and removal of fluid. The length of the tubular container body is such as to extend about a human limb for positional maintenance upon releasable interconnection of its fastening tabs.

The internal chamber defined by the tubular container is divided into a plurality of somewhat separated subchambers. A plurality of orifices communicate between the subchambers to interconnect them for fluid transmission, but yet restrict fluid transmission by reason of both size and array to prevent rapid transfer of large volumes of fluid between the several chambers. One species of such subchambers provides a plurality of serially interconnected cells, a second species provides a batting-like structure within the principal fluidic chamber, and a third species provides a baffle-like structure with diametrically opposed baffles and a flow restricting element therebetween.

In creating such a device, it is:

A principal object to provide an elongate, flexible exercise weight with fastening tabs in its end portions to allow releasable interconnection about a limb of a user for positional maintenance.

A further object is to provide such a device wherein the tubular structure defines an enclosed containment chamber which may be adjustably filled with fluidic weighting medium to provide an exercise device of selectively adjustable mass from which the fluid may be removed during periods of non-use for ease of transport and storage.

A still further object is to provide such a device that, by reason of its flexible nature and particular configuration, adjusts to a substantially filled condition with varying amounts of weighting fluid.

A still further object is to provide such a device that has subdividing structure in the containment chamber to divide that chamber into a plurality of subchambers with orifices or channels communicating therebetween to allow passage of fluid, but prevent the rapid flow of excessive volumes of fluid so that when the device is not completely filled, rapid fluid transfer or "sloshing" by reason of motion of the exercise weight will be lessened or prevented.

A still further object is to provide such a device that is of new and novel design, of rugged and durable nature, of simple and economic manufacture and one otherwise well suited to the uses and purposes for which it is intended.

Other and further objects of my invention will appear from the following specification and accompanying drawings which form a part hereof. In carrying out the objects of my invention, however, it is to be understood that its accidental features are susceptible of change in design and structural arrangement with only one preferred and practical embodiment being illustrated in the accompanying drawings as is required.

BRIEF DESCRIPTION OF DRAWINGS

In the accompanying drawings which form a part hereof and wherein like number of reference refer to similar parts throughout:

FIG. 4 is an orthographic surface view of a second species of my invention having button means for fastening its end tabs together and a batting-like filling to prevent rapid fluid motion.

FIG. 7 is an orthographic surface view of a third species of my invention having a fluid containment chamber with plural diametrically separated septa and a flow restricting element between the diametrically opposed sets of septa to prevent rapid fluid transfer.

FIG. 9 is a medial elongate cross-sectional view of the device of FIG. 7, taken on the line 9—9 of FIG. 8 in the direction indicated by the arrows thereon.

DESCRIPTION OF THE PREFERRED EMBODIMENT

Figures 1, 2, 3:
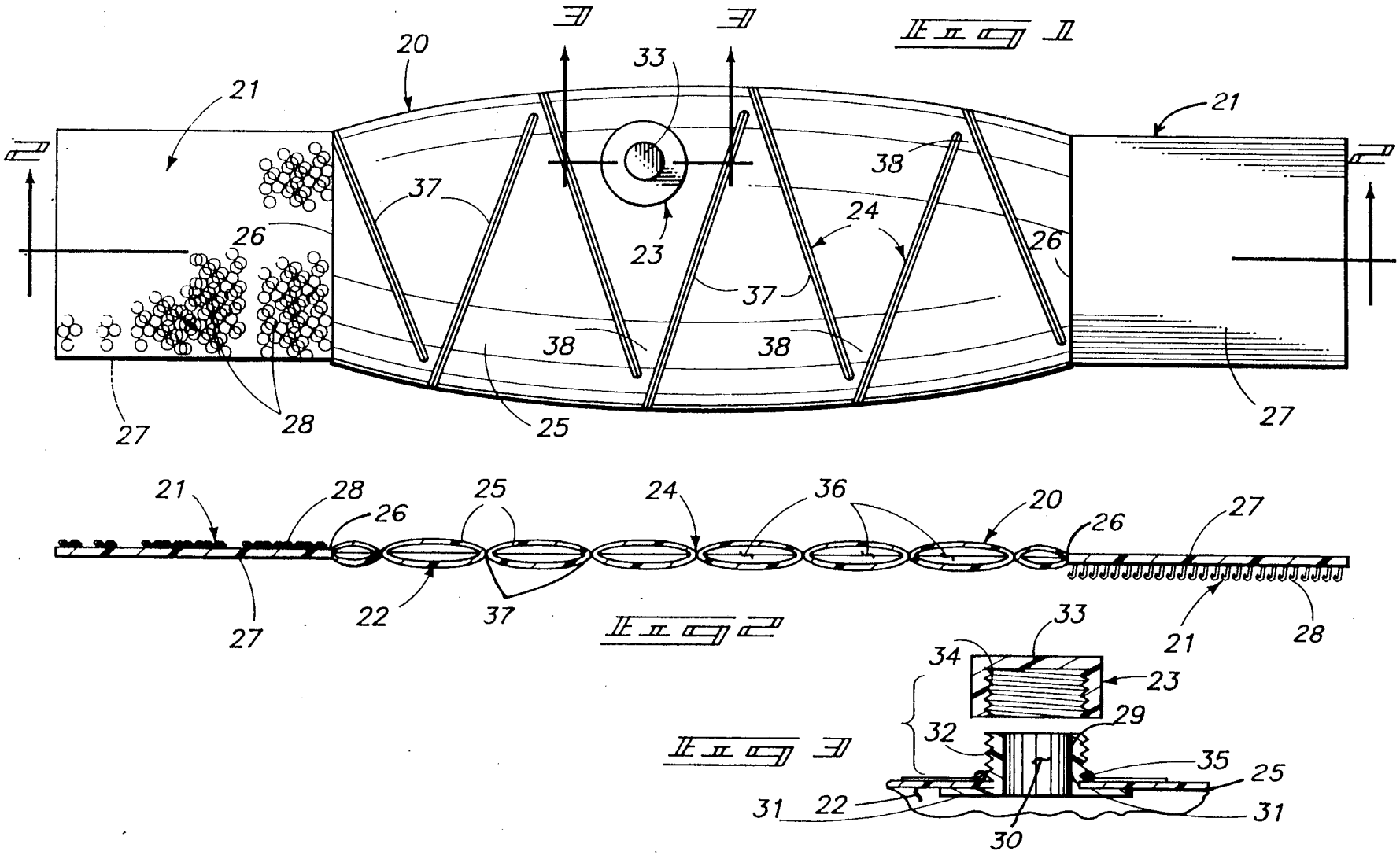
FIG. 1 is an orthographic surface view of my weight device showing various of its elements, their configuration and relationship.
FIG. 2 is a medial elongate cross-sectional view through the device of FIG. 1, taken on the line 2—2 thereon in the direction indicated by the arrows.
FIG. 3 is an enlarged vertical cross-sectional view through the releasably closable filling orifice of the device of FIG. 1, taken on the line 3—3 thereon in the direction indicated by the arrows.

My invention generally provides an exercise weight having elongate flexible body 20 defining fluid chamber 22, with fastening means 21 at each end. The fluid chamber is selectively filled with fluid through closable orifice 23 and contains partition structure 24 to prevent rapid movement of substantial volumes of contained fluid.

Body 20 of the first species of my invention illustrated in FIGS. 1-3 provides elongate tubular membrane 25 sealed at each of its ends 26 to define enclosed fluid chamber 22. This tubular membrane is formed from relatively thin, reasonably flexible material that is impervious and inert to the fluidic weighting material to be contained therein. Sheet plastic of either the polymeric or resinous type is the preferred material and many of the commercially available plastics such as formed from polyethylene, polyester, polyvinyl and the like will serve the purposes of my invention and provide appropriate strength, durability and flexibility. The material commonly will be manufactured in a tubular configuration, but if not, it may be formed from sheet material with edges fastened together by an elongate seam (not shown). The ends 26 of the tubular body, and an elongate seam if present, are joined by fastening processes heretofore known in the plastic art, such as thermal welding, adhesion with solvents or adhesives, or other similar means that form a durable, fluid tight joint that still provides reasonable strength and flexibility approximating those characteristics of the original material.

Figure 10:
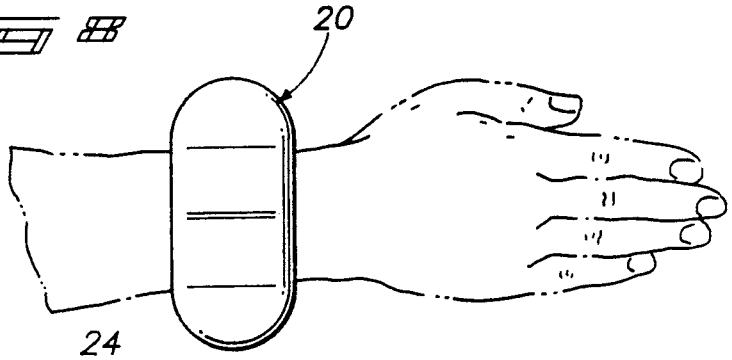
FIG. 10 is a somewhat diagrammatic view showing the use of one of the exercise weights of my invention releasably positioned on a wrist for exercise activity.

Fastening means 21 of the first species comprise rectilinear tabs 27 joined to ends 26 of the tubular membrane to extend in a generally parallel relationship a spaced distance away from each body end. Each tab 27 on one side carries fabric half of a hook and loop type fastener 28, with the half hook and loop fabric type fastener on one tab being on the opposite side of the fastener on the other tab, so that the body may be formed in a closed curve and the two half fabric loop and pile type fasteners brought into surface communication for releasable and somewhat adjustable fastening of the device about a limb, as illustrated particularly in FIG. 10.

Dimensioning and configuration of body 20 is critical to my invention in some aspects. The combined length of the body and tabs, that is distance between the outer edges of opposed tabs 27, must be such that the body may wrap around a portion of a human extremity which is to support it, with sufficient portions of the half fabric loop and pile type fasteners 28 overlapping for releasable fastening engagement. The volume defined by fluid chamber 22 must be sufficient to contain a volume of fluidic medium required to provide the maximum mass desired for a particular exercise device, and preferably the chamber should not be any larger to avoid the potentiality of excess sloshing of fluid therein. The width of the body, that is its longest dimension perpendicular to its length, is not particularly critical, but will necessarily be somewhat regulated by the relationship of the body length to the desired volume of the fluid chamber.

Closable orifice 23 provides structure for establishment and removal of fluid in fluid chamber 22. In the instance illustrated, orifice 29 is defined in body membrane 25, normally in a somewhat medial position and of a size to accept orifice nipple 30. Nipple 30 provides a short length of rigid tube having outwardly flaring fastening flange 31 in its inner portion, to fit about the inner surface of orifice 29 of the body membrane for fastening. Threaded outer portion 32 of the nipple extends spacedly outwardly from the outer surface of the body membrane to fastenably engage cap 33 having internal threads 34 configured for such purpose. The flange 31 is attached to the annular area of tubular member 25 about the periphery of orifice 29 by joining methods known in the plastic arts, depending upon the nature of the materials involved, but most commonly by thermal welding or adhesion. It is necessary that the cap member create a fluid tight seal upon nipple 30, and this may be accomplished by fine definition and good fit of the threads engaging the two elements, and may be aided by annular "O" ring 35, in the instance illustrated carried about the nipple at its intersection with the outer surface of the tubular membrane 25 in a position to engage the adjacent portion of the skirt of cap 33. The nipple 30 and cap 33 must be sufficiently rigid to allow them to accomplish their purpose and because of this, they normally will be formed from more rigid material than tubular membrane 25, which is more flexible. Preferably the nipple and cap are formed from one of the harder, more dense and semi-rigid plastic materials, though other materials having similar physical properties, especially such as metals, might be used for the purpose. This type of closable orifice is not novel itself, and various other forms of closable orifices heretofore known but having different structures are usable with my invention, if possibly not so effectively so.

Partitioning structure 24 in the first species of my invention divides the fluid chamber into a plurality of subchambers 36 formed by fastening linear portions 37 of the adjacent sides of tubular membrane 25 together. In the instance illustrated, the portions 37 that form septa or divisions between subchambers 36 are arrayed in angulated fashion to create plural subchambers of generally triangular configuration having a base along one side of tubular membrane 25 and an apex substantially at the other side of that membrane. This particular form of subdivision is not essential and the portions 37 may be otherwise arrayed, but the array illustrated is convenient of formation and has been found to be quite effective and efficient to serve its purpose.

The linear portions 37 of tubular membrane 25 that are fastened together on their adjacent surfaces may be fastened by known plastic fastening means, but most commonly by plastic welding or some type of adhesion, depending upon the nature of the plastics involved. In general, the joinder should be such as to create a watertight seal, as illustrated and described, but it is possible that a plurality of orifices might be defined between adjacent chambers if those orifices in their cumulative total size are small enough to prevent the rapid transfer of substantial volumes of fluid therethrough.

Each subchamber 36 communicates with an adjacent subchamber by an orifice 38, which in essence is an unjoined area of the two side portions of the tubular membrane 25. The size of orifices 38 is adjusted to regulate the passage of fluid therethrough and prevent excessive fluid transfer, but yet the size of the orifices must allow filling of all subchambers from one closable orifice 23. The various orifices 38 are related to each other, preferably in a fashion such as illustrated in FIG. 1, with the orifice between a medial chamber being distant from the orifice to an adjacent chamber and each chamber having only one orifice communicating to one adjacent chamber, to form a series type interconnection of the chambers as illustrated.

Figure 5:
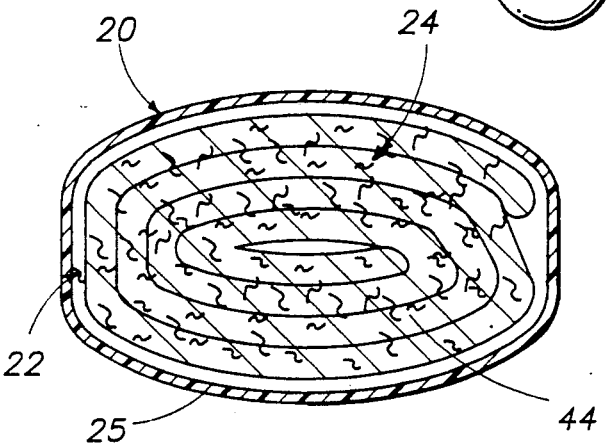
FIG. 5 is a transverse cross-section through the device of FIG. 4, taken on the line 5—5 thereon in the direction indicated by the arrows.
Figure 6:
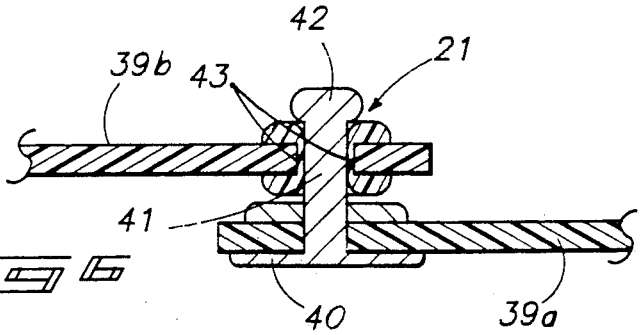
FIG. 6 is an enlarged cross-sectional view showing a button of the first tab fastenably engaged in a hole of the second tab of the device of FIG. 4.

A second species of my invention is shown in the illustrations of FIGS. 4–6, wherein the fastening means 21 and partitioning structure 24 differ from those elements of the first species of my invention.

In this second species fastening means 21 provide a similarly configured elongate fastening tab 39, but the means of fastening one tab to the other differs. One fastening tab **39*a* defines plural spaced snap type, button-like structures which are fastened in an orifice appropriately defined in opposed fastening tab 39*b*. The button structure includes an elongate shank 41 carrying larger bulbous button portion 42 spacedly distant from flange 40. The other fastening tab 39*b* defines hole on a medial line defining the length of the body 20. With this structure, the elongate body may be configured to form a closed curve and may be fastened in that configuration by inserting button element 42 through hole 43** defined in the opposite fastening tab to releasably and adjustable fasten the two ends of the body for positional maintenance on a limb. This fastening structure is not novel itself, and other similar known snap type fastening structures serving a similar purpose are within the scope in my invention.

In this second species tubular membrane 25 defines a cylindrical structure without any interconnection between the inner surfaces of the member. The partitioning structure 24 provides fibrous material 44, preferably formed from polymeric fibers that are relatively flexible and impervious to the fluid which is to he contained in containment chamber 22. The material may he formed as a felted blanket or if desired, may have woven or otherwise pervious sheet-like surface elements on both sides of a layer of felted or matted fibers to aid in maintaining configurational definition and provide some additional structural integrity. With either type of formation of the fibrous member, that member should remain reasonably flexible so that when in place it may be readily formed into a closed curve with the body fastening tabs interconnected with each other. The fibrous material may take the form of a thinner sheet rolled upon itself to form an appropriately configured filler, as illustrated, or may comprise a single unsegregated mass of material (not illustrated). In either case the overall size of the fibrous material in relaxed condition should be such as to reasonably well fill the fluid chamber defined by a particular tubular membrane when in an expanded condition.

Figure 8:
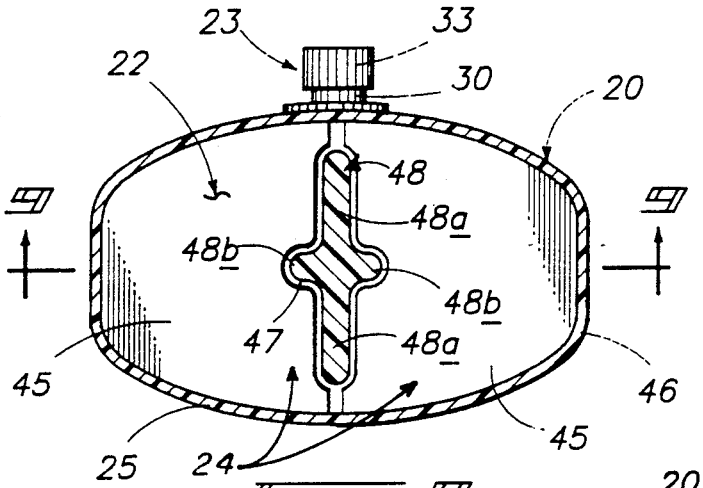
FIG. 8 is a somewhat enlarged traverse cross-sectional view of the device of FIG. 7, taken on the line 8—8 thereon in the direction indicated by the arrows.

The species of my invention shown in FIGS. 7-9 differs from the first and second species in providing a different partitioning structure 24 that in this instance comprises a plurality of spaced septa which divide fluid chamber 22 into a plurality of interconnected subchambers.

This third species provides septa 45, shown especially in the cross-sectional view of FIG. 8, each of which defines approximately one diametrical half of the expanded cross-sectional shape of tubular member 46 that carries them. The septa on each diametrical half of the tubular body member are arrayed in spaced parallel angulated fashion, as illustrated. The inner medial portion of each septa defines indentation 47 to receive one-half of medial flow restricting partition 48. The septa carried by one half of tubular membrane 25 are angulated to the septa defined in the other diametrical half of that tubular membrane, as illustrated particularly in FIG. 9, to provide the herringbone type configuration there illustrated. The septa 45 are all shaped similarly so as to have their medial adjoining portions spacedly adjacent and define the channel 47 to receive medial flow restricting partition 48 between the diametrically opposed sets of septa.

Medial flow restricting partition 48 is an elongate element that extends the length of tubular membrane 25 between ends 26, where it is supported in its end parts. The cross-sectional configuration of the element defines a cross-like structure illustrated in FIG. 8, with longer arms 48*a* and shorter arms 48*b*. The arms 48*a* are oriented to extend substantially along a diameter of the tubular body extending between the inner portions of the opposed sets of septa, and the shorter arms are medially positioned to extend perpendicularly to fit within the channels defined by the septa to receive them. With this structure, fluid flow in chamber 22 between subchambers 49 defined by the plurality of septa is substantially restricted by the maze formed by the septa and partition to tend to prevent any rapid movement of substantial volumes of fluid between portions of the fluid chamber. The septa and flow restricting partition are formed of flexible material, most commonly of the same nature as that from which the tubular membrane 25 is formed, and for ease of manufacturing the entire structure may be formed in two similar halves and joined by seaming at its side edges accordingly to known manufacturing procedures in the plastic forming arts. The fastening means 21 and closable orifice 23 of this third species are the same as those corresponding structures defined for the first species.

Having described the structure of my invention, its use may be understood.

An exercise device is constructed according to the foregoing specification and in the form of one of the species described. The configurational parameters of the exercise device are so selected that the fluid containment chamber is sufficiently large to contain the maximum amount of fluid that may be required to create the maximum desired weight for the device. The length of tubular membrane 25 is determined so as to be appropriate to fit in a reasonably snug, positionably maintainable fashion about a particular portion of a limb of a user whereat the device is to be maintained. Commonly for average exercising, the size of a particular exercise weight may be fairly universally determined as the adjustment parameters allowed by the fastening means ordinarily are sufficient to allow use of one standardized configuration within the range of variance commonly desired, especially when the exercise device is positioned about the ankles or wrists of a user where it most generally will be used.

The exercise weight is then filled with an appropriate amount of fluid by removing cap 33 from the closable orifice 23 and after filling, the cap is replaced to provide a fluid-tight closure. The fluidic weighting material preferred for this purpose is water, as it is reasonably inert, has no particular chemical reactivity with common plastic materials and has a reasonable density so as not to require too large a volume to create weights in the range normally desired for my device. Undoubtedly, other fluidic material of different density or characteristics may be used, but there is little purpose in so doing. Various preservatives may be added to the water if desired or necessary, especially for periods of long use, to prevent microbal or chemical actions from such contaminants as may be present in water, but commonly this is not necessary nor desirable.

The amount of fluid with which the fluid chamber is filled may be finely regulated to provide an exercise weight that is almost infinitely variable in mass up to a maximum of the mass of the volume of fluid that may be contained in the fluid chamber. A simple way to determine the amount of fluid required to produce a desired weight is to fill the container to a premeasured volume that may be marked on the tubular body or to place the device on a scale and fill it to the desired weight, when the cap may then be replaced.

After the exercise weight has been filled with fluid and the cap securely replaced on the closable orifice, the apparatus is ready for use. Commonly it will be used by placing it about the wrists or ankles of a user, though it may be used by placing it about some other portion of the user's limbs, if desired. To accomplish this positioning, the exercise weight is manually wrapped about the limb in a position whereat it is to be supported, and its two fastening tabs are brought into overlapping adjacency so that they may be releasably fastened to each other to positionally maintain the device. The length of the fastening tabs is such as to allow some variance in the circumferential dimension of the exercise weight when so positioned. Commonly it is desirable that the weight be fairly snugly secured about a body portion whereat it is to be maintained so that it may be fairly easily positionally maintained against inertial forces and changes in the size of body parts during motions common in exercise functions. The relatively thin plastic materials from which my exercise weight is formed are somewhat elastically resilient and by reason of this nature tend to aid in accommodating such configurational changes and in positionally maintaining the exercise device. Obviously the longer the tab structure is the more variance will be allowed in fastening, and generally there is substantial variance in the size limit for this structure, though usually a variance of a few inches is sufficient for most practical purposes.

After one or more of the exercise devices are positioned on the limbs of a user as described, they are ready for use in traditional exercise functions. Commonly, but not necessarily, when limbs are exercised, a pair of exercise weights will be used on each of a pair of similar limbs and those weight normally will have the same amount of fluid to produce the same mass. It is possible, however, especially in therapeutic type exercise or athletic training, that it may be desirable to use only one or more than two such devices on one limb or on a combination of body parts, and it may be desirable that if plural devices are used that they have different masses. All of these uses may be quite readily accomplished with my invention as disclosed.

After use of the device, it may be removed from a limb by releasing the fastenable interconnection of the fastening tabs and if desired, it may be emptied of fluid to provide a structure of lesser volume and lesser weight for storage or transport. Since water is almost universally available, the refilling of the device and disposal of its fluidic contents generally pose no particular practical problems.

It should be noted that in using my device its structure provides ready accommodation for varying amounts of fluid, with or without air pockets in the fluid chamber. The cross-sectional shape of the elongate body will tend to vary somewhat to accommodate varying amounts of fluid, being wider and shorter with larger amounts and somewhat thinner and longer with smaller amounts. Additionally with the partitioning structure of any of the species of my invention disclosed, whether the fluid chamber be completely filled with fluid or not, the fluid that is present will be prevented from moving in any substantial quantities within any short period of time to prevent a sloshing type action. This sloshing action generally is not desirable in exercise devices because it tends to be aesthetically unappealing to a user and if it be severe enough, it may prevent proper exercising movement of body parts and may disrupt balance and timing of motions by an exercising user. All of the partitioning structures disclosed tend in varying degrees to prevent any such rapid motion of large volumes of fluid from one portion of the tubular member chamber to another portion.

The foregoing description of my invention is necessarily of a detailed nature so that a specific embodiment of it might be set forth as required, but it is to be understood that various modifications of detail, rearrangement and multiplication of parts might be resorted to without departing from its spirit, essence or scope.

Having thusly described my invention, what I desire to protect by Letters Patent and

What I claim is:

1. An exercise weight fillable with selective amounts of fluidic medium to provide variable mass, comprising in combination:

an elongate body peripherally defined by a tubular membrane of resiliently flexible material having its opposed ends closed to define a fluid chamber for containment of weighting fluid, said body having a length to extend around a limb of a user whereat it is to be positioned and defining fastening tabs at each elongate end;

fastening means carried by the fastening tabs at each opposed end of the body to releasably fasten to each other in adjustable relationship to maintain the body in an annular configuration about a limb of a user;

a closable orifice communicating through the tubular membrane of the body to the fluid chamber defined therein to allow filling and emptying of fluidic medium in the fluid chamber; and flexible partitioning structure carried within the fluid chamber to prevent rapid passage of substantial volumes of fluid between parts of the chamber's said partitioning structure comprising a plurality of angulated linear portions of the opposed surfaces of the tubular membrane fastened together to form a series of triangle-like subchambers extending between the opposed longer sides of the body, each subchamber interconnected with an adjacent subchamber by a single orifice, all subchambers having at least one orifice communicating to an adjacent subchamber, and orifices defined in adjacent partitions being distal from each other and adjacent opposite longer sides of the body.

* * * * *